United States Patent [19]

Hutchings

[11] 3,963,604

[45] June 15, 1976

[54] COMBINATION PROCESS FOR HYDROREFINING AN ASPHALTENIC HYDROCARBONACEOUS CHARGE STOCK

[75] Inventor: Leroi E. Hutchings, Mount Prospect, Ill.

[73] Assignee: UOP Inc., Des Plaines, Ill.

[22] Filed: Sept. 30, 1975

[21] Appl. No.: 618,200

Related U.S. Application Data

[63] Continuation-in-part of Ser. No. 413,132, Nov. 5, 1973, abandoned.

[52] U.S. Cl. ..... 208/211; 208/210

[51] Int. Cl.[2] ..... C10G 23/00

[58] Field of Search ..... 208/211, 209, 210, 212, 208/216

[56] References Cited

UNITED STATES PATENTS

| | | | |
|---|---|---|---|
| 2,761,815 | 9/1956 | Hutchings | 208/212 |
| 2,922,759 | 1/1960 | Schlinger | 208/212 |
| 2,959,538 | 11/1960 | Weikart et al. | 208/211 |
| 3,167,499 | 1/1965 | Haresnape et al. | 208/216 |
| 3,471,397 | 10/1969 | Fortman | 208/209 |
| 3,668,116 | 6/1972 | Adams et al. | 208/216 |
| 3,715,303 | 2/1973 | Wennerberg et al. | 208/216 |

*Primary Examiner*—Delbert E. Gantz
*Assistant Examiner*—G. J. Crasanakis
*Attorney, Agent, or Firm*—James R. Hoatson, Jr.; Thomas K. McBride; William H. Page, II

[57] ABSTRACT

Hydrorefining of asphaltenic hydrocarbonaceous mixtures utilizing a first catalytic reaction zone for vapor phase refining and a second catalytic reaction zone for liquid phase refining thereby minimizing maldistribution of the feedstock in the reaction zones.

3 Claims, 1 Drawing Figure

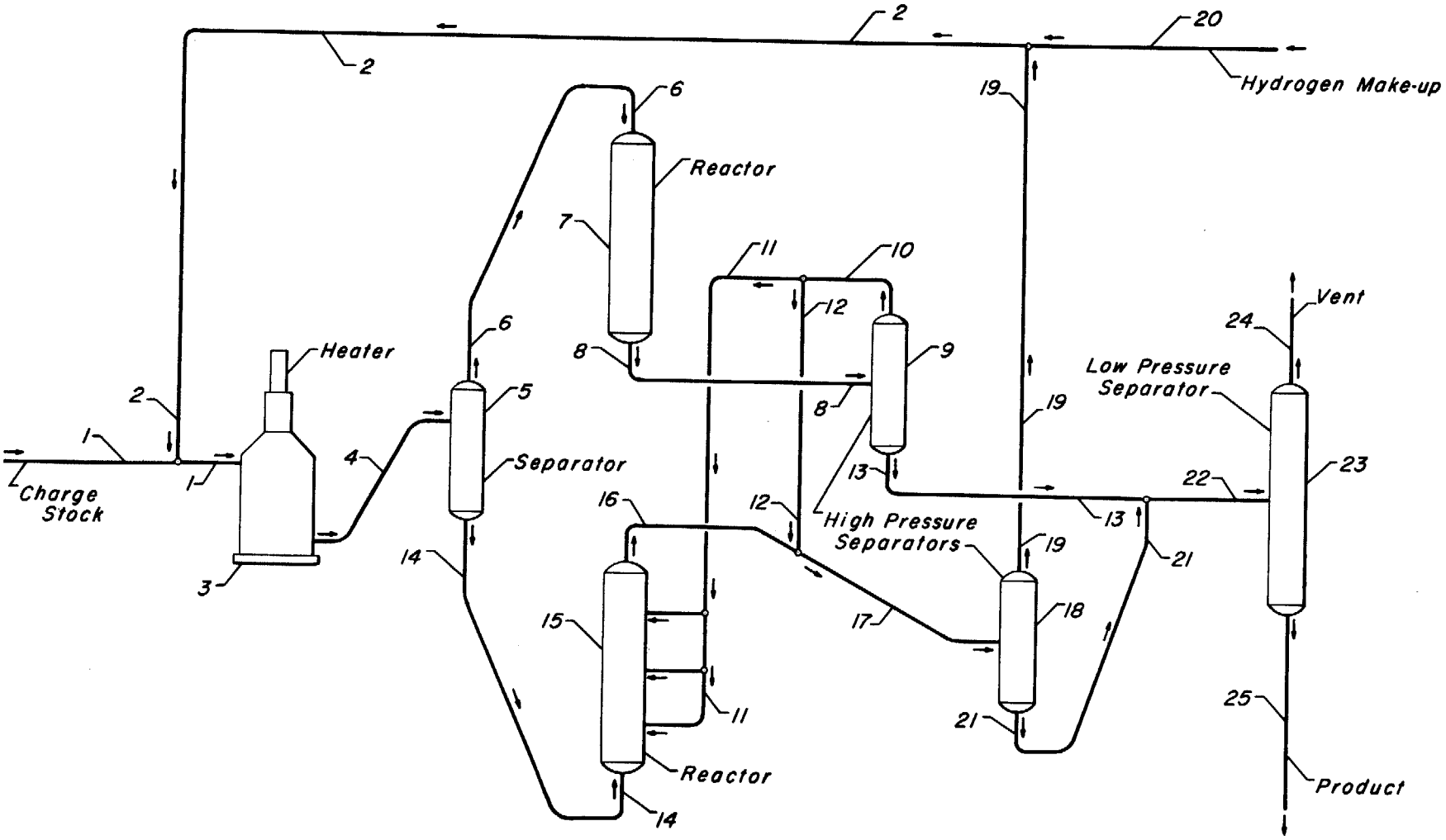
Hydrogen Make-up
Vent
Product
Low Pressure Separator
High Pressure Separators
Reactor
Reactor
Separator
Heater
Charge Stock
1
2
3
4
5
6
7
8
9
10
11
12
13
14
15
16
17
18
19
20
21
22
23
24
25

COMBINATION PROCESS FOR HYDROREFINING AN ASPHALTENIC HYDROCARBONACEOUS CHARGE STOCK

CROSS-REFERENCE TO RELATED APPLICATION

The present application is a continuation-in-part of my copending application, Ser. No. 413,132, filed Nov. 5, 1973, now abandoned, all the teachings of which copending application are incorporated herein by specific reference thereto.

The combination process described herein is adaptable to the hydrorefining of asphaltenic hydrocarbonaceous charge stocks. More specifically, the present invention is directed toward a combination process for the desulfurization of hydrocarbonaceous residuals including atmospheric tower bottoms product, vacuum tower bottoms product, crude oil residuum, topped and/or reduced crude oils, crude oil extracts, crude oils extracted from tar sand, oil shale, etc.

Petroleum crude oils and particularly the heavy residuals extracted from tar sands, topped or reduced crudes and vacuum residuum, contain high molecular weight sulfurous compounds in exceedingly large quantities, nitrogenous compounds, high molecular weight organo-metallic complexes, principally comprising nickel and vanadium as the metal component, and heptane-insoluble asphaltic material. The latter is generally found to be complexed with, or linked to sulfur, and to a certain extent with the metallic components. A black oil can be generally characterized as a heavy hydrocarbonaceous material of which more than 10% boils above a temperature of 1050°F. (referred to as non-distillable), and having a gravity of less than 20° API. Sulfur concentrations are exceedingly high, most often greater than 2 percent by weight, and may range as high as 5 percent by weight. Conradson Carbon Residue factors exceed 1 weight percent and a great proportion of black oils exhibit a Conradson Carbon Residue factor above 10. An abundant supply of such hydrocarbonaceous material currently exists, most of which has a gravity less than 10° API, and which is characterized by a boiling range indicating that 30 percent or more boils above a temperature of 1050°F.

Nitrogenous and sulfurous compounds are objectionable since the combustion of various fuels containing these impurities causes the release of nitrogen oxides and sulfurous oxides which are noxious, corrosive and present, therefore, a serious problem with respect to pollution of the earth's atmosphere. Nitrogen is particularly undesirable since it effectively poisons various catalytic composites which may be employed in subsequent processes for the conversion of these petroleum fractions.

In addition, black oil charge stocks contain a high-boiling fraction comprising high molecular weight asphaltenic compounds. These are non-distillable, oil-insoluble coke precursors. Asphaltenes are generally colloidally dispersed within a petroleum crude oil, vacuum or tower bottoms product, and, when subjected to various reactions at elevated temperatures, have the tendency to polymerize, thereby making conversion thereof to more valuable distillable hydrocarbons extremely difficult.

The primary difficulty in hydrorefining an asphaltone containing black oil resides in carbon formation due to the asphaltenic compounds, such carbon formation being favored as a result of the insolubility of these asphaltenic compounds. A gummy carbonaceous deposit is formed and causes the catalyst particles to become bound together, thereby restricting the flow of reactants through the catalyst bed. Furthermore, the presence of asphaltenes interferes with the capability of the catalyst to effect a reduction in sulfurous and nitrogenous compounds.

The desirability of removing the foregoing described contaminating influences is well known within the art of petroleum refining. Heretofore, heavy black oils have been hydrorefined utilizing two principal approaches: liquid phase hydrogenation and vapor phase hydrocracking. In the former type of process, the oil is passed upwardly in liquid phase and in admixture with hydrogen, existing as a separate phase, through a fixed bed or slurry of sub-divided catalyst. Although perhaps effective in removing oil-soluble, organo-metallic complexes, such a process is relatively ineffective with respect to the oil-insoluble asphaltenes which are colloidally dispersed within the charge stock. Since the hydrogenation zone is at an elevated temperature, the retention of these unconverted asphaltenes, suspended in free liquid phase oil for an extended period of time, results in polymerization, causing conversion thereof to become substantially more difficult. Vapor phase hydrocracking is effected either with a fixed bed or a fluidized bed at temperatures substantially above about 950°F. While this technique obviates to some extent the drawbacks of liquid phase hydrogenation, it is not well-suited to treat the heavy hydrocarbon fractions because their non-volatility causes coke formation, with the result that the catalytic composite succumbs to rapid deactivation: this type of system requires a large capacity catalyst regeneration facility in order to implement the process on a continuous basis. Since the rate of diffusion of the oil-insoluble asphaltenes is significantly lower than that of dissolved molecules of approximately the same molecular size, a fixed bed process in which the charge stock and hydrogen are passed in a downwardly direction has been thought to be impractical. Selective hydrorefining of a wide boiling range charge stock is not easily obtained and excessive amounts of gases are produced at the expance of more valuable normally liquid hydrocarbons. The deposition of excessive quantities of gummy carbonaceous material results in plugging of fixed bed catalyst beds, as well as restriction of the recirculation in a fluidized catalyst system.

I have observed that hydrorefining of a two-phase system has met with only limited success because of improper flow distribution resulting in imperfect contact by the charge with all of the available catalytic sites in a reaction zone. When a portion of the catalyst bed becomes wetted and the liquid phase begins to take a preferred path through the reaction zone, the charge stock fails to be thoroughly treated. At the same time, the rush of the gaseous phase in the form of volatile hydrocarbons and hydrogen tends to further accelerate the trickle of the liquid phase through the preferred channels or routes, which only compounds the initial problem. In a liquid phase hydrogenation, the lack of a uniform flow distribution is not as severe as in the two-phase system but the problem nevertheless exists. The channeling in the reaction zone is reduced since the hydrocarbon charge is entirely in the liquid phase but the accompanying hydrogen present in the vapor phase only aggravates the inability to create uniform distribution of the charge stock in a reaction zone.

I have found that if the hydrocarbons which are contained in a selected charge stock and which are volatile at reaction zone conditions are removed and processed in a conventional vapor phase reaction zone, the nonvolatile remainder, together with dissolved hydrogen, may be readily and easily processed in a fixed-bed catalytic reaction zone without the detrimental effects of uneven flow distribution. Since hydrogen is consumed in hydrorefining, the dissolved hydrogen must be continuously replaced in order to prevent coking in a manner which does not create a vapor phase to ensure even flow distribution. A suitable technique is to add hydrogen directly to the reaction zone via a multiplicity of injection points located along the direction of flow.

A principal object of the present invention is to provide a continuous process for hydrorefining an asphaltene containing charge stock such as petroleum crude oil which process alleviates the uneven flow distribution problem associated with the two-phase processing system.

Another object is to hydrorefine heavy hydrocarbon charge stocks, a significant amount of which exhibits a boiling range above a temperature of 1050°F., i.e., at least about 10 percent boils above this temperature, and often more than 30 percent, into high yields of fuel oil containing less than 1 percent by weight of sulfur and preferably less than 0.5 percent sulfur.

In one embodiment, therefore, the present invention encompasses a combination process for hydrorefining an asphaltenic hydrocarbonaceous charge stock containing at least one contaminant from the group of sulfurous compounds and nitrogenous compounds to produce a fuel oil product containing less than 10% by weight of sulfur which process comprises the steps of: (a) admixing said charge stock with hydrogen in an amount of from 2000 to about 6000 S.C.F./bbl. and heating the resulting mixture to a temperature of 600°F. to 800°F. and a pressure of about 1000 psig. to about 4000 psig.; (b) separating the heated mixture in a first separation zone to provide a first vapor phase and a first liquid phase containing hydrogen dissolved therein; (c) hydrorefining the first vapor phase with a first hydrorefining catalyst in a first hydrorefining zone to obtain a first hydrorefined effluent; (d) hydrorefining the first liquid phase with a second hydrorefining catalyst in a second fixed-bed hydrorefining zone to obtain a second hydrorefined effluent; (e) separating said first hydrorefined effluent, in a second separation zone at a temperature of from about 60°F. to about 140°F., and a pressure substantially the same as that of said first hydrorefining zone to provide a hydrogen-rich second vapor and a second liquid phase; (f) passing a portion of said hydrogen-rich second vapor to said hydrorefining step (d) in an amount of from 200 to about 2000 S.C.F./bbl. of liquid charge; (g) separating said second hydrorefined effluent in a third separation zone to provide a hydrogen-rich third vapor phase and a third liquid phase; and, (h) recovering said fuel oil product from said second liquid phase and said third liquid phase.

Other embodiments of my invention, as hereinafter set forth in greater detail, reside primarily in particularly desirable process variables and processing techniques.

Other objects and embodiments of my invention will be evident from the following, more detaled description of the present combination process.

Before describing my invention with reference to the accompanying drawing and by way of illustrating the manner in which it facilitates hydrorefining an asphaltenic hydrocarbon, several definitions are believed necessary in order that a clear understanding is afforded. In the present specification, the phase "pressure substantially the same as," is intended to connote that pressure under which a downstream vessel is maintained, allowing only for the pressure drop experienced as a result of the flow of fluids through the system. That is, no specific, intentional means will be employed to reduce the pressure. Conversion conditions are intended to be those conditions imposed upon the catalytic conversion zone in order to hydrorefine the black oil. The conversion conditions are intended to include temperatures in the range from about 650°F. to about 800°F., measured at the inlet of the catalyst bed. Since the bulk of the reactions are exothermic, the reaction zone effluent will be at a higher temperature. In order that catalyst stability be preserved, it is preferred to control the inlet temperature such that the affluent temperature does not exceed about 900°F. Hydrogen is initially mixed with the black oil charge stock, by means of compression recycle in an amount generally less than about 10,000 s.c.f./bbl., at the selected operating pressure, and preferably in an amount of from about 2000 to about 6000 s.c.f./bbl. The operating pressure will be greater than 1000 psig. and generally in the range of about 1500 psig. to about 4000 psig. The oil passes through the catalytic reaction zones at a liquid hourly space velocity defined as volumes of liquid hydrocarbon charge per hour, measured at 60°F., per volume of catalyst disposed in the reaction zone, of from about 0.2 to about 2. When conducted as a continuous process, it is particularly preferred to introduce the distillable portion of the black oil into the reaction zone in such a manner that the same passes through the zone in downward flow. The non-distillable portion may likewise be processed in downward fashion but the preferred processing method is upflow. In some instances, as a way to more fully ensure that even flow distribution is obtained in the catalytic reaction zones, it may be desirable to provide the reaction zone with a packed bed or beds of inert material such as particles of granite, procelain, beryl saddles, sand, aluminum or other metal turnings, etc., or to employ perforated trays or special mechanical means for this purpose.

As hereinbefore set forth, hydrogen is employed in admixture with the charge stock and preferably in an amount of from about 3000 to about 6000 s.c.f./bbl. The hydrogen-containing gas stream, herein sometimes designated as "recycle hydrogen," since it is conveniently recycled externally of the hydrorefining zones, fulfills several functions: it serves as a hydrogenating agent and a heat carrier. Since some hydrogenation will be effected, there will be a net consumption of hydrogen; to supplement this, make-up hydrogen is added to the system from any suitable external source. The catalytic composite disposed within the reaction zones can be characterized as comprising a metallic component having hydrogenation activity, which component is composited with a refractory inorganic oxide carrier material of either synthetic or natural origin. The precise composition and method of manufacturing the carrier material is not considered essential to the present process, although a siliceous carrier, such as 88.0% alumina and 12.0% silica, or 63.0% alumina and 37.0% silica, are generally preferred. Suitable metallic components having hydrogenation activity are those selected from the group consisting of the metals of Group VI-B and VIII of the Periodic Table, as indicated in the Periodic Chart of the Elements, Fisher Scientific Company, (1953). Thus, the catalytic composite may comprise one or more metallic components from the group of molybdenum, tungsten, chromium, iron, cobalt, nickel, platinum, palladium, iridium, osmium, rhodium, ruthenium, and mixtures thereof. The concentration of the catalytically active metallic component, or components, is primarily dependent upon the particular metal as well as the characteristics of the charge stock. For example, the metallic components of Group VI-B are preferably present in an amount within the range of about 1.0% to about 20.0% by weight, the iron-group metals in an amount within the range of about 0.2% to about 10.0% by weight, whereas the platinum-group metals are preferably present in an amount within the range of about 0.1% to about 5.0% by weight, all of which are calculated as if the components existed within the finished catalytic composite as the elemental metal.

The refractory inorganic oxide carrier material may comprise alumina, silica, zirconia, magnesia, titania, boria, strontia, hafnia, and mixtures of the two or more including silica-alumina, alumina-silica-boron phosphate, silica-zirconia, silica-magnesia, silica-titania, alumina-zirconia, alumina-magnesia, alumina-titania, magnesia-zirconia, titania-zirconia, magnesia-titania, silica-alumina-zirconia, silica-alumina-magnesia, silica-alumina-titania, silica-magnesia-zirconia, silica-alumina-boria, etc. It is preferred to utilize a carrier material containing at least a portion of silica, and preferably a composite of alumina and silica with alumina being in the greater proportion.

The effluent from the reaction phase reacton zone is passed into a suitable, high pressure separator from which the normally liquid hydrocarbons are recovered, while at least a portion of the hydrogen-rich gaseous phase is used to replace hydrogen consumed in the liquid phase reaction zone and the remainder, if any, joins the liquid phase reaction zone effluent. The liquid phase reaction zone effluent is passed into another high pressure separator from which the normally liquid hydrocarbons are recovered, while the hydrogen-rich gaseous phase is returned to the fresh charge stock stream in admixture with additional external hydrogen required to replenish and compensate for the net hydrogen consumption which may range from about 200 to about 2000 s.c.f./bbl. of liquid charge, the precise amount being dependent upon the characteristics of the charge stock and the severity of the operating conditions. The recycle hydrogen-rich gas stream may be treated by any suitable means for the purpose of effecting the removal of ammonia and hydrogen sulfide resulting from the conversion of nitrogenous and sulfurous compounds. Furthermore, the normally liquid hydrocarbons removed from both high pressure separators are introduced into a low pressure separator for the purpose of removing dissolved normally gaseous hydrocarbons, including methane, ethane propane, hydrogen sulfide and ammonia from the normally liquid hydrocarbon product. Under certain circumstances, it may be desirable to remove normally liquid distillable hydrocarbons along with the normally gaseous hydrocarbons.

Other operating conditions and preferred operating techniques will be given in conjunction with the following description of the present process. In further describing this process, reference will be made to the accompanying FIGURE which illustrates one specific embodiment of my invention.

EXAMPLE

In the drawing, the embodiment is presented by means of a simplified flow diagram in which such details as compressors, pumps, instrumentation and controls, heat-exchange and heat-recovery circuits, valving, start-up lines and similar hardware have been omitted as being non-essential to an understanding of the techniques involved. The use of such miscellaneous appurtenances, to modify the process, are well within the purview of one skilled in the art.

For the purpose of demonstrating the illustrated embodiment, the drawing will be described in connection with the hydrorefining of a crude tower bottoms stream in a commercially scaled unit. It is to be understood that the charge stock, stream compositions, operating conditions, design of reactors, separators and the like, are exemplary only, and may be varied widely without departure from the spirit of my invention, the scope of which is defined by the appended claims. With reference now to the drawing, a crude tower bottoms stream having the properties set forth in Table I, is introduced into the process via line 1:

TABLE I

| Crude Tower Bottoms Properties | |
|---|---|
| Gravity, °API at 60°F. | 14.3 |
| Sulfur, weight percent | 3.0 |
| Nitrogen, p.p.m. | 3830 |
| Pentane-insoluble Asphaltenes, weight percent | 10.9 |
| Distillation, °F. | |
| 10% | 636 |
| 30% | 821 |
| 50% | 924 |
| 60% | 1050 |
| Total Metals, p.p.m. | 91 |

After appropriate heat-exchange with various hot effluent streams, the charge stock, in an amount of 10,000 bbl./day at a temperature of 600°F. and under a pressure of 2500 psig., is admixed with a hydrogen-rich gaseous phase which is introduced via line 2 in an amount of 6000 s.c.f./bbl. The recycle hydrogen-rich stream results in part from a vaporous phase provided by high pressure separator 18, and in part by a hydrogen make-up stream introduced via line 20. The mixture enters heater 3 at a temperature of about 590°F., which temperature is raised to a level of 800°F. The thus heated mixture is charged to separator 5 via line 4. Approximately 35 percent or 3500 bbl./day of the charge stock together with undissolved hydrogen-rich gas is withdrawn from separator 5 in the vapor phase via line 6 and charged to reactor 7.

Reactor 7 has disposed therein a catalytic composite of 2 percent by weight of cobalt and 8 percent by weight of molybdenum, calculated as the elements, and based upon the total composite. The carrier material consists of finely divided alumina particles. A sufficient quantity of catalyst is placed in reactor 7 such that the liquid hourly space velocity is 2.0.

Approximately, 65 percent or 6500 bbl./day of the charge stock together with dissolved hydrogen-rich gas is withdrawn from separator 5 in the liquid phase via line 14 and charged to reactor 15.

Reactor 15 has disposed therein a catalyst containing 2 percent by weight of cobalt and 12 percent by weight of molybdenum, calculated as the elements and based upon the total composite. The carrier material for this catalyst also consists of finely divided alumina particles. A sufficient quantity of catalyst is placed in reactor 15 such that the liquid hourly space velocity is 0.5.

The effluent from reactor 7 passes via line 8 to high pressure separator 9 which is maintained at essentially the same pressure as reactor 7. A vapor phase is withdrawn from high pressure separator 9 via line 10. A portion of this vapor phase passes via lines 10 and 11 to reactor 15 which vapor phase is used to replace dissolved hydrogen which is consumed by the hydrorefining reaction in reactor 15. The remainder of the vapor phase from high pressure separator 9 passes via lines 10 and 12 to join line 16 which passes the effluent from reactor 15. Lines 12 and 16 combine to form line 17 which continues to high pressure separator 18.

A hydrogen-rich vapor phase is withdrawn from high pressure separator 18 via line 19 which combines with hydrogen makeup, line 20, to form line 2 which passes hydrogen-rich gas to the above-mentioned line 1 which passes said charge stock.

A liquid phase stream is recovered from high pressure separator 18 via line 21 and another liquid phase stream passes from high pressure separator 9 via line 13. Lines 13 and 21 combine to form line 22 which continues to low pressure separator 23. A vent gas stream is removed via line 24. The stream consists principally of hydrogen, hydrogen sulfide, light paraffinic hydrocarbons including minor quantities of butane, pentane, hexane and heptane to 400°F. gasoline. Where desired, this stream can be further treated to recover any one or a number of these components in substantially pure state. A liquid product stream of 10,200 BB/day, consisting primarily of hydrocarbons boiling at a temperature greater than 400°F., is recovered via line 25. The recovered liquid product stream contains substantially reduced quantities of nitrogen, metal and pentane-insoluble asphaltenes, and the residual sulfur concentration is considerably less than 1 weight percent.

The compositions of the feedstock and recovered product presented in the foregoing example are intended to be illustrative only, and may vary widely depending on the flow rates and other operating variables, including the particular desired product separation. It should be further pointed out that the output streams, represented by lines 24 and 25 are well suited either for further processing or separation to recover particularly desired components. For example, the liquid product stream may be used directly as fuel oil or subjected to hydrocracking to produce additional lower boiling hydrocarbons. The vent gas stream recovered through line 24 can be scrubbed to remove the hydrogen sulfide and subsequently further separated to recover, for example, substantially pure hydrogen and/or butane-plus hydrocarbon fraction. These, as well as other processing schemes will become evident to those skilled in the art.

I claim as my invention:

1. A combination process for hydrorefining an asphaltenic hydrocarbonaceous charge stock containing sulfurous compounds and nitrogeneous compounds to produce a fuel oil product containing less than 1% by weight of sulfur which process comprises the steps of:

a. admixing said charge stock with hydrogen in an amount of from 2000 to about 6000 S.C.F./bbl. and heating the resulting mixture to a temperature of 600°F. to 800°F. and a pressure of about 1000 psig. to about 4000 psig.;

b. separating the heated mixture in a first separation zone to provide a first vapor phase and a first liquid phase containing hydrogen dissolved therein;

c. hydrorefining said first vapor phase with a first hydrorefining catalyst and substantially at said pressure in a first hydrorefining zone to obtain a first hydrorefined effluent;

d. hydrorefining the first liquid phase with a second hydrorefining catalyst in a second hydrorefining zone comprising a fixed bed of said second catalyst to obtain a second hydrorefined effluent;

e. separating said first hydrorefined effluent, in a second separation zone at a temperature of from about 60°F. to about 140°F., and a pressure substantially the same as that of said first hydrorefining zone to provide a hydrogen-rich second vapor phase and a second liquid phase;

f. passing a portion of said hydrogen-rich second vapor phase to said hydrorefining step (d) in an amount of from 200 to about 2000 S.C.F./bbl. of liquid charge;

g. separating said second hydrorefined effluent in a third separation zone to provide a hydrogen-rich third vapor phase and a third liquid phase; and, h. recovering said fuel oil product from said second liquid phase and said third liquid phase.

2. The process of claim 1 further characterized in that the hydrorefining catalyst in said first hydrorefining zone is contacted with said first vapor phase in a downflow manner and the hydrorefining catalyst in said second hydrorefining zone is contacted with said first liquid phase in an upflow manner.

3. The process of claim 1 further characterized in that said hydrogen-rich second vapor phase addition to said hydrorefining step (d) is made via a multiplicity of injection points located along the direction of flow.

* * * * *